US005078289A

United States Patent [19]

Bolton et al.

[11] Patent Number: 5,078,289

[45] Date of Patent: Jan. 7, 1992

[54] CONTAINER WITH MEASURING CUP CLOSURE

[75] Inventors: Stewart L. Bolton, Springfield, N.J.; Edward A. Kozloski, Babylon, N.Y.

[73] Assignee: Kraft General Foods, Inc., Glenview, Ill.

[21] Appl. No.: 494,116

[22] Filed: Mar. 15, 1990

[51] Int. Cl.[5] ..... B65D 55/02

[52] U.S. Cl. ..... 215/228

[58] Field of Search ..... 215/228, 227, DIG. 7, 215/276, 341, 349; 220/212

[56] References Cited

U.S. PATENT DOCUMENTS

| | | | |
|---|---|---|---|
| 814,503 | 3/1906 | Andresen et al. . | |
| 2,543,427 | 2/1951 | Warne | 220/212 X |
| 3,217,917 | 11/1965 | George | 215/228 X |
| 3,433,378 | 3/1969 | Ross | 215/228 X |
| 3,581,927 | 6/1971 | Langdon . | |
| 3,684,120 | 8/1972 | Beeman . | |
| 3,826,395 | 7/1974 | Montgomery | 215/341 X |
| 4,269,319 | 5/1981 | Rubens . | |
| 4,336,891 | 6/1982 | Smith | 215/276 |
| 4,349,056 | 9/1982 | Heino . | |
| 4,416,381 | 11/1983 | Swartwout . | |
| 4,566,508 | 1/1986 | Bowyer . | |
| 4,566,509 | 1/1986 | Szajna . | |

FOREIGN PATENT DOCUMENTS

| | | | |
|---|---|---|---|
| 0109704 | 5/1984 | European Pat. Off. | 215/228 |

OTHER PUBLICATIONS

Research Disclosure, No. 106, Feb. 1973, Disclosed Anonymously.

*Primary Examiner*—Stephen P. Garbe
*Assistant Examiner*—Vanessa M. Roberts
*Attorney, Agent, or Firm*—Thomas A. Marcoux; Thomas R. Savoie

[57] ABSTRACT

A container for a flowable product, such as liquid coffee or the like, having a measuring cup closure. The container neck is preferably closed by an inner seal and has secured thereto the lower portion of a surrounding ring member. An upper portion of this ring member telescopically and lockably receives therein the open end of a measuring cup. An internal flange of the ring member includes a bottom surface which seals against the neck edge and the upper portion includes a circumferential bead which forms a seal with the outside of the open end of the measuring cup.

20 Claims, 6 Drawing Sheets

CONTAINER WITH MEASURING CUP CLOSURE

FIELD OF THE INVENTION

This invention relates to containers, and in particular, it relates to a container having a closure which includes a measuring cup.

BACKGROUND OF THE INVENTION

In many instances, it is desirable to use a measuring cup to measure portions of a flowable product poured from a container. As a convenience, it has been known heretofore to incorporate a measuring cup as part of the container closure, so that the measuring cup is readily available as needed. Examples of such previously known closures including a measuring cup are shown in U.S. Pat. No. 4,349,056 to Heino, U.S. Pat. No. 4,566,508 to Bowyer and U.S. Pat. No. 4,566,509 to Szajna.

However, particular problems exist in connection with certain products, which problems are not solved by known measuring cup container closures. For example, in the case of perishable, flowable products, the closure, must permit the inclusion within the closure, as originally packaged, of an inner seal such as a hermetic seal which will protect the contents of the container during shipping and storage, until opened and refrigerated by the end user. Also, a closure for this type of product must provide an adequate air-tight seal after the original inner seal has been removed, thereby protecting the product during a reasonable refrigeration storage time until the contents of the container have been totally consumed.

Certain products, such as liquid coffee, present the added problem that owing to its water like surface tension such liquids tend to seep through crevices between the various elements of the closure, thereby causing the liquid to run down the outside of the container, creating a messy, unsightly and, hence, commercially unacceptable appearance. Therefore, the various sealing surfaces of the closure must not only protect the product against deterioration, but must also prevent the product from seeping through the various crevices and running down the side of the container.

With all flowable products, but especially such water like liquids, care must also be taken to assure that when returning unused liquid portions from the measuring cup to the container, the product is caused to flow smoothly and efficiently back into the container and that any product remaining on or in the measuring cup drains into the container and is not caused to run down the side of the container.

Thus, a need exists for a new and improved container in combination with a measuring cup closure which satisfies all of the above described requirements.

SUMMARY OF THE INVENTION

It is a purpose of the present invention to provide a container with a new and improved measuring cup type closure which is particularly suitable for a flowable product of the type which requires an original seal and which must provide adequate air-tight sealing after said original seal has been removed. It is preferred to provide such an improved closure for use with a liquid of the type having water like surface tension.

This purpose is achieved in accordance with the present invention by providing, in combination with a container of the type having a neck extending upwardly from the body thereof, a number of closure components which interact with each other to achieve the desired results. A ring member which surrounds the neck includes a lower portion which is attachable to the neck and an upper portion into which the open end of an inverted measuring cup is telescopically received.

In a preferred arrangement, an inner seal closes the top of the container, e.g., it is attached to the edge of the neck around the opening. This inner seal can be of the type which is opened by pushing it through into the neck of the liquid container or punching and removing the inner seal in whole or in part from the neck of the container or of the type which is opened by grasping an edge or a tab and pulling the seal back across the opening.

The ring member includes an inwardly projecting flange which essentially divides the upper portion from the lower portion. The bottom of this flange engages the edge of the neck around its opening so that after the inner seal is removed and the ring is tightened onto the neck, the bottom of the flange forms a liquid-tight, and preferably air-tight, seal with the neck edge, thus preventing fluids from flowing inwardly or outwardly between the neck of the container and the lower portion of the ring member.

The upper portion of the ring member includes threads which match the threads of the upper outside of the measuring cup so that when the upper open end of the measuring cup is inverted and inserted telescopically into the upper portion of the ring member, the measuring cup can be turned and thereby threadedly engaged with the interior of the upper portion of the ring member.

In accordance with a preferred arrangement of the present invention, the top of the ring member flange is slanted upwardly and radially outwardly, preferably at an angle of approximately 45 degrees; and in combination therewith, the upper outside of the measuring cup surrounding its opening is bevelled to mate with the top of the flange. Just above the flange, the inside of the ring member includes a circumferential bead. The threads on the measuring cup and upper portion of the ring member are then so arranged that when the opening of the measuring cup is inserted into the upper portion of the ring member and turned to commence engagement of the threads, and the bevel mates with the top of the flange further turning of the measuring cup within the ring member will cause the measuring cup to move downwardly, such that its bevel engages the top of the flange, and the outside edge of the measuring cup exerts pressure on the circumferential bead on the inside wall of the ring member, thereby creating a fluid-type seal to prevent fluids from flowing between the measuring cup and the upper portion of the ring member.

Once the inner seal has been opened and the end user wishes to consume a portion of the product, the end user should be able to remove the measuring cup to gain access to the container without there concurrently being movement of the ring member off of the neck. This goal is achieved in accordance with the present invention by designing the threads between the lower portion of the ring member and the neck with a much greater holding force than that of the threads between the upper portion of the ring and the measuring cup. For example, the pitch of the threads between the neck and the lower portion of the ring member can be made much smaller than the pitch between the threads of the measuring cup and the upper portion of the ring member. Consequently, as one grasps the measuring cup and turns it, the measuring cup will immediately be released without concurrent turning of the lower portion of the ring member relative to the neck of the container.

It is another feature of the present invention that the container and closure structure be so designed that when an unused previously poured portion is returned from the measuring cup back into the container, that said portion flows smoothly through the closure and back into the container and any remaining liquid will drain smoothly back into the container after the measuring cup has been secured back into the ring member. The slope on the top of the flange which serves the above-described closing function also facilitates the smooth return movement of the unused liquid and draining of any further residue of liquid from the measuring cup back into the container.

Thus, it is an object of the present invention to provide a new and improved container of the type having a measuring cup closure.

It is still another object of the present invention to provide a new and improved measuring cup type closure, especially adaptable for use with a perishable product of the type requiring an initial inner seal and adequate fluid-tight seals after removal of the original inner seal.

It is still another object of the present invention to provide a new and improved closure of the type described which is especially suitable for use with liquids having water like surface tension so as to prevent such liquids from seeping through the various crevices of the closure and down the side of the container.

It is still another object of the present invention to provide a new and improved measuring cup type closure which comprises a ring member which surrounds a neck of the container, the lower portion thereof engaging the neck of the container, and the upper portion thereof having the measuring cup secured thereto, and including a flange dividing the upper and lower portions of the ring member, the bottom of the flange and the upper portion of the ring member cooperating with the neck of the container and the outside of the measuring cup, respectively, to form sealing surfaces.

It is still another object of the present invention to provide a closure member of the type described wherein the measuring cup can be conveniently and easily removed from its surrounding ring member without concurrent removal of said ring member from the neck of the container.

These and other objects of the present invention will become apparent from the detailed description to follow.

BRIEF DESCRIPTION OF THE DRAWINGS

There follows a detailed description of preferred embodiments of the present invention which are to be read together with the accompanying drawings wherein:

FIGS. 5 and 6 show the upper portion of the container and the closure elements of FIG. 2 after complete removal of an inner seal, wherein FIG. 5 is an exploded central cross-sectional view showing the top of the container and the closure elements separated vertically from each other and FIG. 6 is a central cross-sectional view showing the elements of FIG. 5 connected together;

FIGS. 7 and 8 show the container and the closure elements of FIG. 2 when using the modified inner seal of FIG. 4, wherein FIG. 7 is an exploded central cross-sectional view showing these elements separated vertically from each other, and FIG. 8 is a central cross-sectional view showing these elements connected together;

DETAILED DESCRIPTION OF THE PREFERRED EMBODIMENTS

Figure 1:
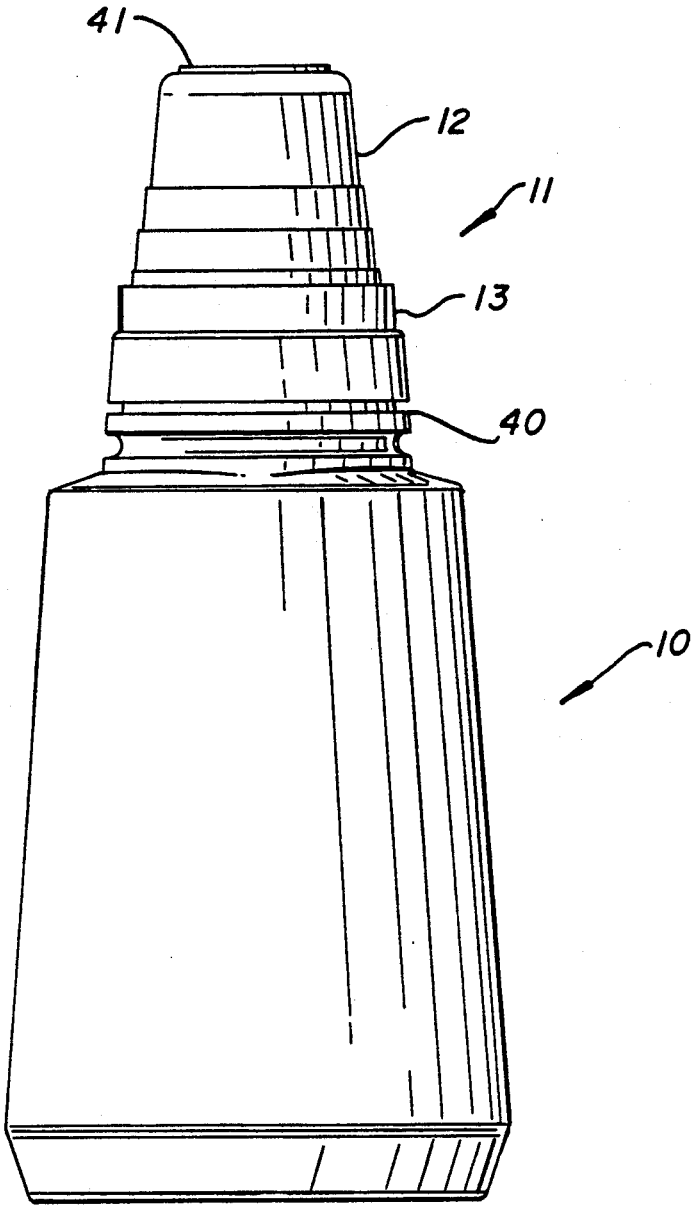
FIG. 1 is a side elevational view of a container of the present invention including a measuring cup type closure.

Referring now to the drawings, like elements are represented by like numerals throughout the several views.

FIG. 1 illustrates a container 10 incorporating the new measuring cup closure of the present invention. The cap 11 of this container includes a measuring cup 12, the lower open end of which is telescopically received within a ring member 13. Although not illustrated in the figure, the container may also include an overwrap in the form of a shrink neck band extending from below a container neck bead 40 to a height somewhere along or over the top of the measuring cup 12.

Figure 2:
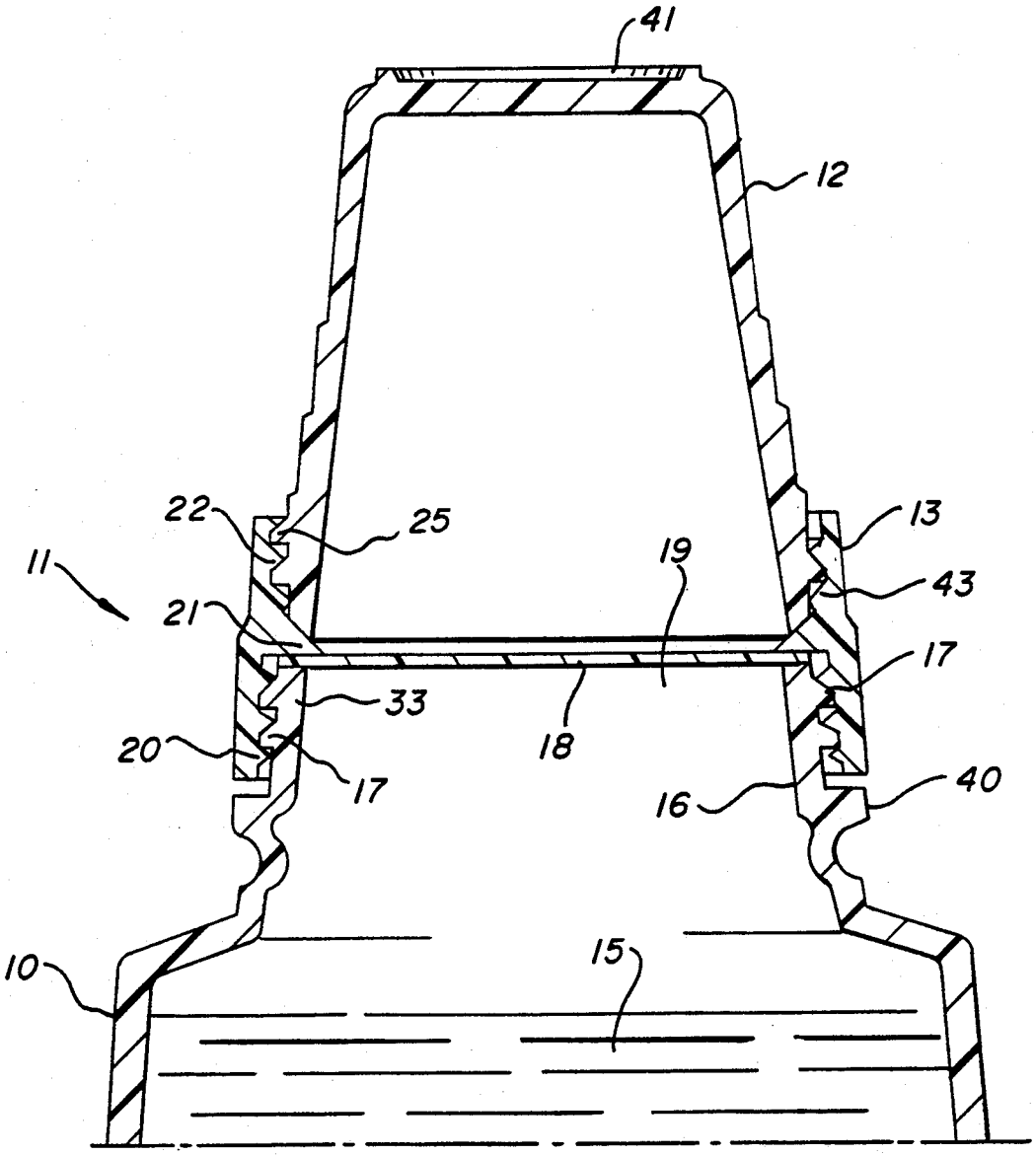
FIG. 2 is an enlarged central cross-sectional view of the upper portion of FIG. 1.

Referring to FIG. 2, (as well as FIGS. 5–8) the container 10 would normally be supplied with contents in the form of a flowable material, and in one preferred application of the invention, that material would be a liquid 15, for example, liquid coffee. FIGS. 1 and 2 illustrate the container and the cap 11 in the form as the container would be distributed in commerce, except for the omission of an overwrap, as described above. The container 10 includes an upwardly extending neck 16, the top of which forms a circular neck edge 33. If the product contained within the container 10 is perishable in nature, as the package is originally distributed in commerce, a foil inner seal 18 would be attached to the neck edge 33. Depending on the characteristics of the contents 15, the seal 18 may or may not be a hermetic seal. If the contents are liquid coffee, a perishable product, the foil inner seal 18 would be hermetically attached to the neck edge 33.

Figure 3:
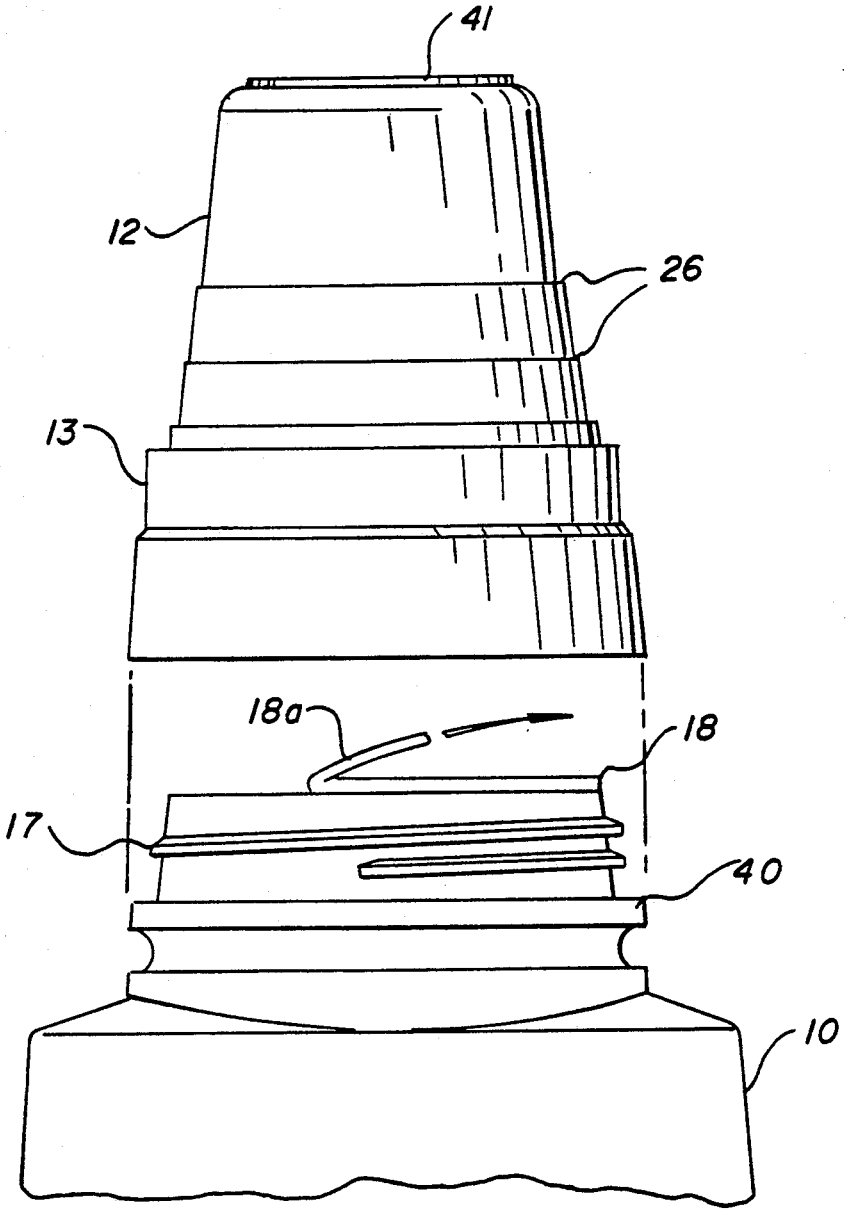
FIG. 3 is an enlarged exploded view showing the upper portion of FIG. 1 with the closure elements separated from the container and moved together upwardly away from the neck of the container.
Figure 4:
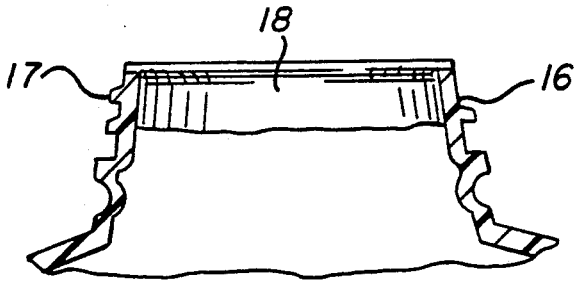
FIG. 4 is a central, cross-sectional view of the upper portion of the container of FIG. 2 with the closure elements removed therefrom, and showing a modification of the present invention.

FIGS. 3 and 4 illustrate two different forms of a foil inner seal 18, either of which can be hermetic or nonhermetic. These forms differ, however, in the manner by which each is intended to be opened. FIG. 3 illustrates an inner seal 18 provided with a tab or edge **18*a* and intended to be removed by having the end user grasp the tab or edge 18*a* and peel back the inner seal. FIG. 4 illustrates a type of foil inner seal 18 intended to be opened by having the end user punch the inner seal 18 inwardly, pushing it through the opening 19 and back against the inside of neck 16** all about the circumference thereof. Alternatively, although not illustrated, the inner seal of FIG. 4 can be removed by puncturing it and removing it in whole or in part.

Figure 5:
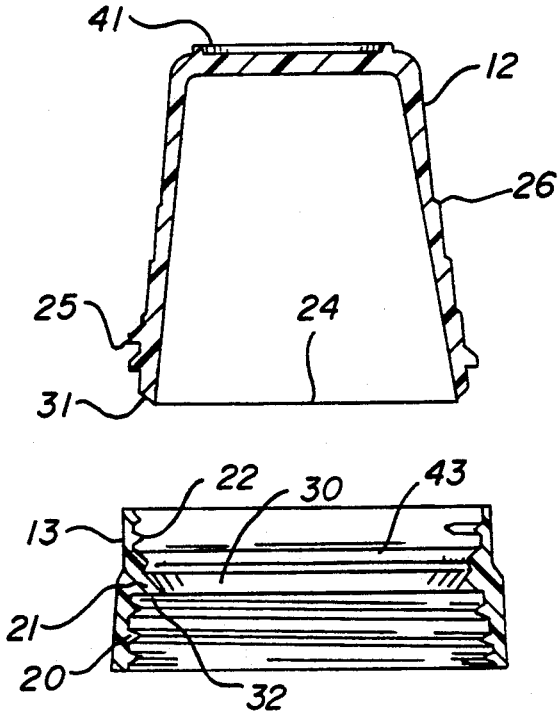
Figure 5:
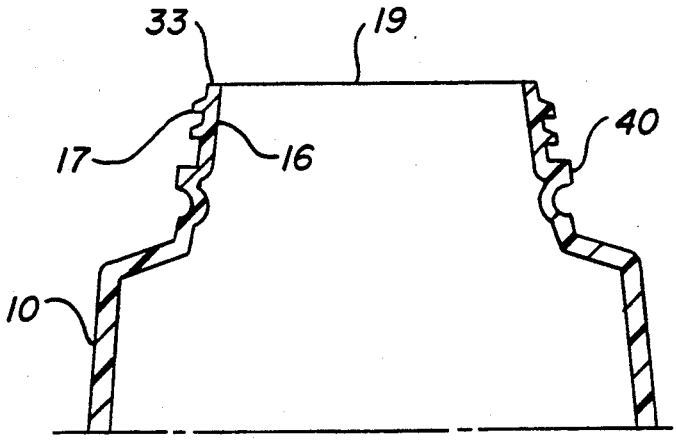

The details of ring member 13 and measuring cup 12 will be made clear by referring to FIGS. 5–8, as well as FIG. 2. Referring first to FIG. 5, the ring member 13 includes an inwardly directed internal flange 21 which separates the ring member into a lower portion therebeneath and an upper portion thereabove. The lower portion includes internal threads 20 which mate with the external threads 17 of the neck 16. The upper portion of ring member 13 includes internal threads 22 which mate with the external threads 25 of the measuring cup 12. The flange 21 includes a generally horizontal bottom 32 and an upwardly radially outwardly slanted top 30. A circumferential sealing bead 43 is located just above flange 21.

The measuring cup 12 includes a bottom, sides and an open top 24 (as shown in the figures, the measuring cup is inverted so that the opening 24 is lowermost). The measuring cup preferably includes volume indicators, in this case, ridges 26. Assuming that the measuring cup is at least translucent, if not transparent, the end user can use these ridges 26 as indicators of the volume poured into the measuring cup. The measuring cup also includes external threads 25 which mate with the internal threads 22 of ring member 13. It will be noted that in a preferred embodiment of the present invention, the edge of the measuring cup surrounding and defining the opening 24 is bevelled at 31 on the exterior portion thereof. The measuring cup also preferably includes a stand up ring 41 on its bottom.

The flange 21 cooperates with the neck 16 in order to effect a proper air- or liquid-tight seal therewith and bead 43 cooperates with the outside of the measuring cup to form a proper air-tight or liquid-tight seal therebetween. FIG. 2 illustrates the container in the form as distributed in commerce with the foil inner seal 18 in place. With this seal in place, the provision of air-tight or liquid seals formed by the flange 21 or bead 43 and their respective mating surfaces is less important.

End users can be expected to remove the foil inner seal 18 in a number of different ways, and it is a feature of the present invention that the cap 11 must be capable of effecting adequate air-tight or liquid-tight seals after the end user has initially opened the inner seal 18, for all possible variations by which the end user might effect opening thereof.

For example, preferred instructions to the end user would be to remove the ring member 13 to gain complete access to the inner seal 18 and then to remove the same either by peeling it back, if the embodiment of FIG. 3 has been used, or punching it through the opening 19, or puncturing it and removing it in whole or in part if the embodiment of FIG. 4 has been used. In some cases, the neck edge 33 will be completely free of any portion of the inner seal 18 while in other cases, depending on the adherence between inner seal 18 and the neck edge 33 and/or the degree of care taken by the end user, a portion of the outer edge of the inner seal 18 will remain adhered to the neck edge 33. In the alternative, whether the package contains the inner seal of FIG. 3 or the inner seal of FIG. 4, many end users will no doubt avoid the preferred instructions and simply remove the measuring cup 12 and, without even removing the ring member 13, punch the inner seal 18 down into the opening 19 of the neck 16. It is important that the cap 11 provide a proper seal between the ring member 13 and the neck 16 for any of these variations of inner seal embodiments and/or end user opening procedures.

Figure 6:
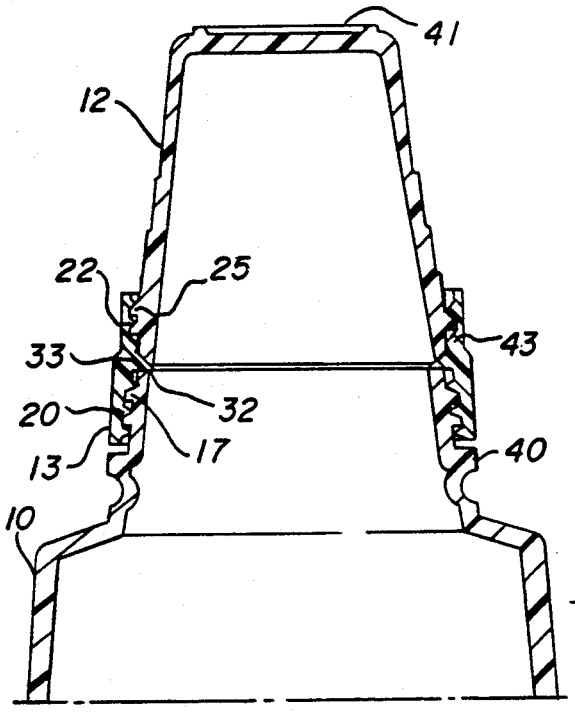
Figure 8:
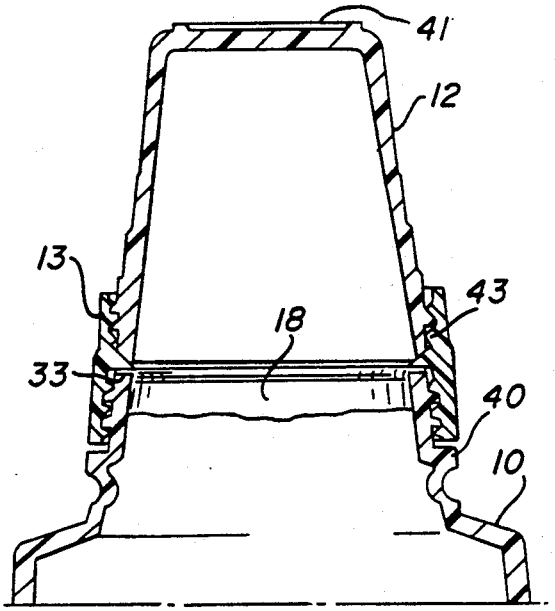
Figure 7:
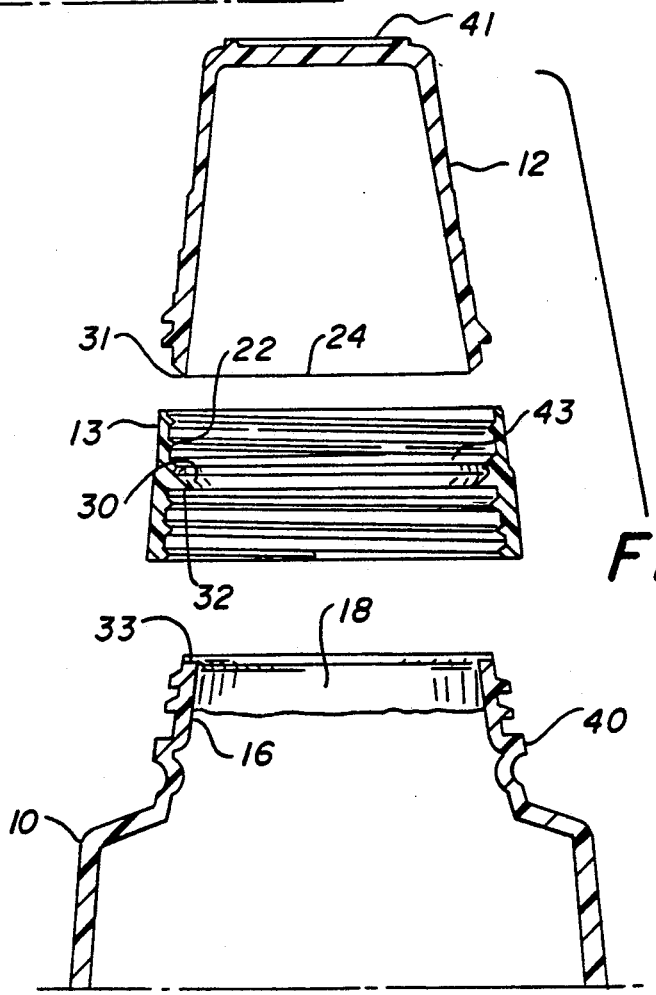

FIG. 6 illustrates the engagement of the bottom 32 of the flange 21 with the neck edge 33 in the case where the neck edge 33 has had the inner seal 18 completely removed therefrom. FIGS. 7 and 8 illustrate this flange to neck edge sealing engagement when a portion of inner seal 18 has remained in place on neck edge 33. In this case, the ring member 13 remains at a height slightly higher than in FIG. 6, relative to neck edge 33. However, even in the condition shown in FIG. 8, the ring member 13 is threadedly engaged onto the neck 16 with sufficient force to create a liquid- or air-tight seal as between the bottom 32 and the neck edge 33.

FIGS. 5 and 6, or FIGS. 7 and 8, illustrate in an identical manner the relationship between the measuring cup 12 and the interior of the ring member 13. The internal and external threads 22 and 25 are so positioned that as the measuring cup 12 is moved telescopically down into the ring member 13, with the opening 24 lowermost and the bevelled edge 31 of the measuring cup 12 just beginning to mate with the top 30 of the flange 21, as the external threads 25 become initially engaged with the internal threads 22, the outside wall of the measuring cup becomes resiliently forced against circumferential bead 43, locking in the measuring cup and creating an air-tight or liquid-tight seal between the measuring cup 12 and the ring member 13. In a preferred embodiment the angle of slant of the top 30 is approximately 45 degrees and the angle of the bevelled edge 31 is also approximately 45 degrees.

After the container has been initially opened by the end user and the cap resecured, the end user will subsequently reopen the container a number of times before the contents are completely consumed. To effect such reopenings, the end user will grasp the measuring cup 12 and turn it to remove the same to gain access to the container; and at these times it is desirable that the ring member 13 not be turned. In order to provide easy and reliable removal of the measuring cup and equally reliable non-movement of the ring member 13, the cap is constructed such that the measuring cup 12 is moved with a force much less than that required to turn the ring member 13 relative to neck 16. In a preferred arrangement, this is accomplished by constructing the threads 22 and 25 interconnecting the ring member and the measuring cup with a substantially larger pitch than the threads 17 and 20 interconnecting the neck 16 and the lower portion of the ring member 13. Although this is the preferred arrangement for assuring easy removal of the measuring cup while not moving the ring member 13, this differential force can be accomplished in other ways. For example, the materials utilized for the respective components of the container and closure may be such that the frictional forces as between the ring member 13 and the measuring cup 12 are substantially less than the frictional forces as between the ring member 13 and the neck 16.

Although the operation, i.e., the method of use of the present invention will be apparent from the preceding discussion, for clarity the operation will be briefly summarized below.

The end user will purchase the product in the form as shown in FIG. 1 although, as noted above, an overwrap may enclose ring member 13 and the crevices just above and just beneath it. The end user, after removing the optional overwrap, would then remove the inner seal 18. The end user would be instructed to preferably remove the ring member 13, with the measuring cup 12 still attached thereto, to gain complete access to the inner seal 18. The instructions would then be to completely remove the inner seal 18, either by pulling back an edge or tab, if the embodiment of FIG. 3 is used. If the embodiment of FIG. 4 is used, without the tab 18*a*, different end users would remove the inner seal 18 in different ways. Some might grasp an edge or puncture it and try to remove it completely, while others might simply punch it in and push it back against the interior of neck 16. Still other end user can be expected to ignore such preferred instructions and initially remove only the measuring cup 12, not the ring member 13, and simply push the inner seal 18 down into the neck and back against the inside wall thereof.

Figure 9:
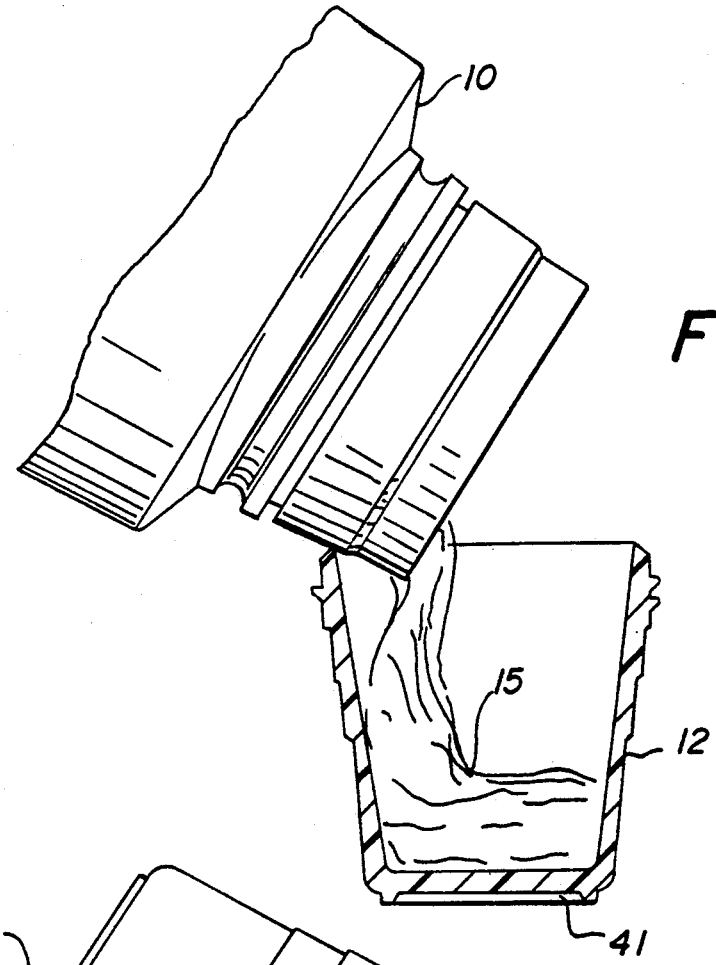
FIG. 9 is a schematic view illustrating the pouring of liquid product from the container into the measuring cup.
Figure 10:
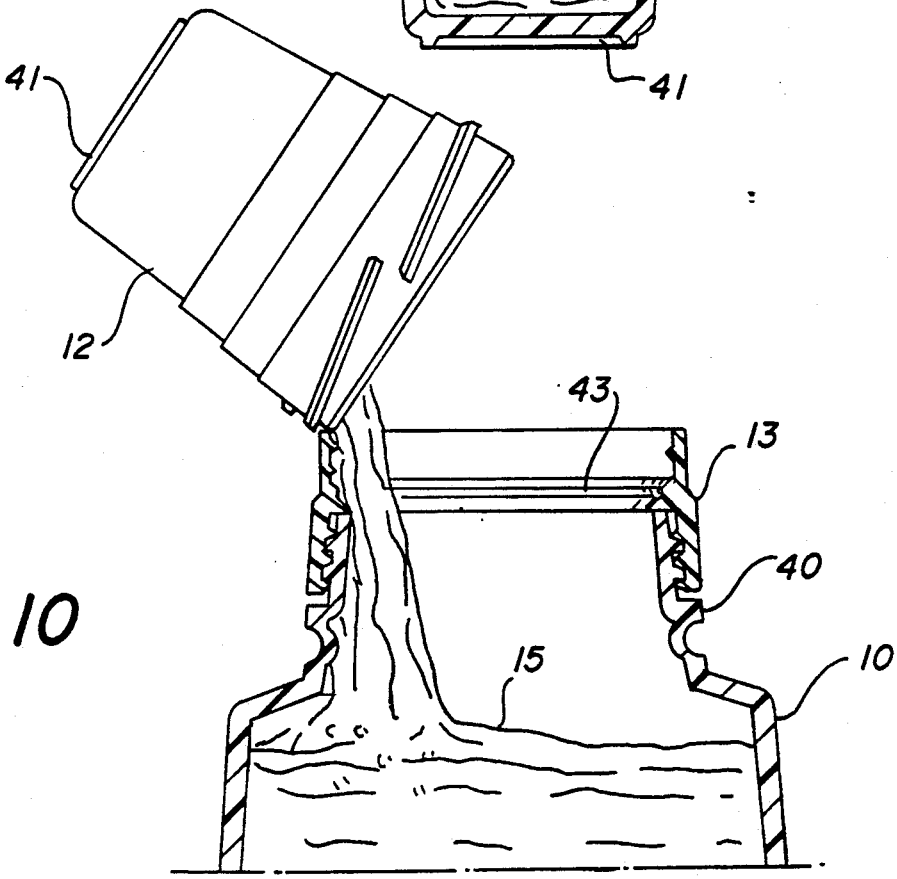
FIG. 10 is a schematic view illustrating the pouring of unused liquid product from the measuring cup back into the container.

In any event, after the end user has completed the opening of the inner seal 18 and wishes to consume the contents thereof, the end user will pour a desired quantity directly into the measuring cup 12, as shown in FIG. 9. Since liquid coffee would be a concentrated product, the small amounts which would fill the measuring cup 12 up to the various ridges would represent a larger amount of finished coffee, the precise proportion depending on the product and, of course, provided in instructions to the end user. In any event, after a selected quantity of the liquid product had been poured from the measuring cup into the end user's coffee cup, coffee pot or the like, there could be a small portion remaining in the measuring cup which would preferably be poured back into the container. One problem which exists with respect to a liquid having water like surface tension such as liquid coffee, is to assure that the product flows smoothly back into the container without dripping down its side. Then, after the measuring cup is secured onto the container, any residue should effectively drain back into the container. The present invention accomplishes these results in several ways. First, the seal between the bottom 32 of the flange and the neck edge 33 assures that liquid poured back or drained into the container does not seep out through crevices between the neck 16 and the ring member 13. Second, the slope on the top 30 of the flange 21 provides for a smooth, continuous, efficient flow of the liquid back into the container. FIG. 10 illustrates the pouring back of the unused liquid from the measuring cup 12 back into the container 10, the liquid flowing across the top 30 of the flange 21. Third, since the open top of the measuring cup fits completely within the upper portion of the ring member 13, with reasonable handling of the measuring cup, it can be brought down into the ring member 13 without any liquid falling onto the outer side of ring member 13 or the container 10. Finally, as the measuring cup 12 is tightened down onto the flange 21, in the manner described above, any residual liquid remaining on the flange would drain inwardly, falling into the container 10. The flange 21 preferably has the same inside diameter as neck opening 19. However, it may be slightly larger or slightly smaller.

Although the components of the present invention can be made of many different materials, in order to achieve the necessary seals, it is necessary that the ring member 13 and the measuring cup 12 be formed of suitable synthetic resilient materials. Preferred materials for either the ring member or the measuring cup could include thermoplastics, e.g., polypropylene, polyethylene, polystyrene, etc.

Although the invention has been described in considerable detail with respect to preferred embodiments thereof, it will be apparent that the invention is capable of numerous modifications and variations, apparent to those skilled in the art, without departing from the spirit and scope of the invention.

We claim:

1. A container of the type intended for a flowable product, and having a body and a neck portion and which has a measuring cup closure, comprising:

a neck extending up from a body of the container and having an edge defining an upper opening and a planar openalbe inner seal attached to the said edge to close said upper opening, a ring member surrounding the neck and having a lower portion, an upper portion and an inwardly extending circumferential flange dividing the lower and upper portions, the lower portion including means for attachment to said neck, the bottom of the flange being engagable with said edge to seal against liquid flow therebetween, and a measuring cup having a closed bottom, sides and an open top, the open top being telescopically receivable within said upper portion and means for removably locking said measuring cup opening into liquid-tight engagement with the upper portion.

2. A container according to claim 1, the ring member being threadedly engaged with the neck, and the measuring cup being threadedly engaged with the upper portion, the holding force of the threaded engagement of the ring member with the neck being substantially greater than the holding force of the threaded engagement between the measuring cup and the ring member, such that normal removal of the measuring cup by the unscrewing thereof does not also unscrew the ring member from the neck.

3. A container according to claim 1, said flange having a generally horizontal bottom and a radially outwardly, upperwardly slanted top, the bottom mating with said neck edge to form a removable, liquid-tight seal and the upper portion of the ring member flange mating with the measuring cup to form another removable liquid-tight seal.

4. A container according to claim 3, wherein the inside diameter of the flange is approximately equal to the inside diameter of the neck edge, forming a generally continuous surface for the flow of flowable product.

5. A container according to claim 3, wherein the slant of the top of the flange is approximately 45 degrees.

6. A container according to claim 1, wherein the ring member is threadedly engaged with the neck, and said inner seal is secured to said neck edge, located between the neck edge and the bottom of the flange.

7. A container according to claim 6, wherein the inner seal is secured to the neck edge completely around the circumference of the neck edge and is openable by the punching thereof down into the neck or removing all or part thereof.

8. A container according to claim 6, wherein the inner seal is secured to the neck edge completely around the circumference of the neck edge and includes a peel-back edge or tab, said inner seal being removable by pulling back the tab.

9. A container according to claim 1, said inner seal being an air-tight hermetic seal secured to the neck edge.

10. A container according to claim 1, wherein the means for removably locking the measuring cup to the ring member includes a threaded engagement therebetween.

11. A container according to claim 10, wherein the top of the ring member flange is slanted radially outwardly and upperwardly, the open top of the measuring cup including a bevel on the outer side of the opening, and the inside of the ring member includes a circumferential bead, the matching threads of the measuring cup and the ring member initially engaging each other essentially as the bevel engages the slanted top of the flange, such that further turning of the measuring cup within the ring member to further engage their respective threads causes resilient pressure and, hence, liquid-tight sealing between the outside of the measuring cup and the bead of the ring member.

12. A container intended for a perishable, liquid such as liquid coffee, comprising:

a body portion;

a neck extending up from said body portion to an edge defining an upper opening;

a removable air-tight hermetic seal secured to the neck edge;

a ring member surrounding the neck and having a lower portion, an upper portion, an inwardly extending circumferential flange dividing the lower and upper portions and a circumferential bead just above the flange, the bottom of the flange engaging the neck edge so as provide a liquid-tight seal to prevent the passage therebetween of the liquid whether (1) the inner seal has been completely removed, in which case the flange bottom directly engages the neck edge or (2) the inner seal has not been completely removed at its outer edges, in which case the flange bottom engages remaining portions of the inner seal to effect said liquid seal; and a measuring cup having a closed bottom, sides and an open top, said measuring cup being adapted for receiving and dispensing liquid poured out of the container, the open top of the measuring cup being telescopically receivable within said upper portion of the ring member, and means for removably locking said measuring cup open top in liquid-tight engagement with the upper portion.

13. A container according to claim 12, wherein the top of the flange is slanted upwardly and radially outwardly to provide a smooth angle surface for the flow of the liquid into and out of the container.

14. A container according to claim 13, wherein the inside diameter of the flange is generally equal to the inside diameter of the neck edge, forming a generally continuous surface for the flow of the liquid into and out of the container.

15. A container according to claim 14, wherein the slant of the top of the flange is approximately 45 degrees.

16. A container according to claim 12, wherein the ring member is threadedly engaged with the neck and the measuring cup is threadedly engaged with the upper portion of the ring member, the holding force of the threaded engagement of the ring member with the neck being substantially greater than the holding force of the threaded engagement between the measuring cup and the ring, such that normal removal of the measuring cup by the unscrewing thereof would not also open the liquid-tight seal between the neck edge and the ring member.

17. A container according to claim 12, wherein the measuring cup is threadedly engaged with the inside of the ring member, and wherein the top of the ring member flange is slanted radially outwardly and upwardly, the open top of the measuring cup including a bevel on the outer side of the opening, and the inside of the ring member includes a circumferential bead, the matching threads of the measuring cup and the ring member initially engaging essentially just as the bevel engages the slanted top of the flange, such that further turning of the measuring cup within the ring member to engage their respective threads causes resilient pressure and liquid-tight sealing between the outside of the measuring cup and the bead of the ring member.

18. A container of the type intended for a flowable product, and having a body and a neck portion and which has a measuring cup closure, comprising:

a neck extending up from a body of the container and having an edge defining an upper opening and an openable inner seal closing said upper opening, a ring member surrounding the neck and having a lower portion, an upper portion and an inwardly extending circumferential flange dividing the lower and upper portions, the lower portion including means for attachment to said neck, the bottom of the flange being engagable with said edge to seal against liquid flow therebetween, the top of the flange being slanted upwardly and radially outwardly and the inside diameter of the flange being approximately equal to the inside diameter of the neck edge, forming a generally continuous surface for the flow of flowable product, and a measuring cup having a closed bottom, sides and an open top, the open top being telescopically receivable within said upper portion and means for removably locking said measuring cup opening into liquid-tight engagement with the upper portion.

19. A container according to claim 18, wherein the slant of the top of the flange is approximately 45°.

20. A container of the type intended for a flowable product, and having a body and a neck portion and which has a measuring cup closure, comprising:

a neck extending up from a body of the container and having an edge defining an upper opening and an openable inner seal closing said upper opening, said inner seal being an air-tight hermetic seal secured to the neck edge, a ring member surrounding the neck and having a lower portion, an upper portion and an inwardly extending circumferential flange dividing the lower and upper portions, the lower portion including means for attachment to said neck, the bottom of the flange being engagable with said edge to seal against liquid flow therebetween, and a measuring cup having a closed bottom, sides and an open top, the open top being telescopically receivable within said upper portion and means for removably locking said measuring cup opening into liquid-tight engagement with the upper portion.

* * * * *